United States Patent [19]

Omeechevarria

[11] 3,958,378

[45] May 25, 1975

[54] BURIAL CRYPT

[76] Inventor: Gerardo Omeechevarria, P.O. Box 10881, Caparra Heights Sta., P.R. 00922

[22] Filed: Oct. 22, 1974

[21] Appl. No.: 516,961

Related U.S. Application Data

[63] Continuation of Ser. No. 313,337, Dec. 8, 1972, abandoned.

[52] U.S. Cl. ..... 52/136; 52/79

[51] Int. Cl.[2] ..... E04H 13/00

[58] Field of Search ..... 220/378; 52/134–138, 52/140, 396, 403, 79, 169; 27/2, 7

[56] References Cited

UNITED STATES PATENTS

| | | | |
|---|---|---|---|
| 912,368 | 2/1909 | Downey | 52/136 |
| 998,908 | 7/1911 | King | 52/130 |
| 1,204,686 | 11/1916 | Raydure | 52/136 |
| 1,523,851 | 1/1925 | Althoff | 52/136 |
| 1,752,572 | 4/1930 | Person | 52/134 |
| 2,598,422 | 5/1952 | Paul | 220/378 |
| 2,913,895 | 11/1959 | Blasius | 52/137 |
| 3,287,865 | 11/1966 | Lockman | 52/136 |
| 3,295,271 | 1/1967 | Dorris | 52/137 |
| 3,701,452 | 10/1972 | Tonn | 220/378 |
| 3,772,826 | 11/1973 | Ferver | 52/137 |

FOREIGN PATENTS OR APPLICATIONS

| | | | |
|---|---|---|---|
| 498,192 | 10/1950 | Belgium | 52/136 |

*Primary Examiner*—John E. Murtagh
*Attorney, Agent, or Firm*—Cushman, Darby & Cushman

[57] ABSTRACT

This invention relates to a self-contained precast modular burial crypt that is quickly and easily assembled at any situs. Further, the burial crypt is provided with an improved sealing arrangement to maintain an air-tight and secure fit between the various modular units.

5 Claims, 5 Drawing Figures

BURIAL CRYPT

This is a continuation, of application Ser. No. 313,337 filed Dec. 8, 1972, now abandoned.

BACKGROUND OF THE INVENTION

The present invention is directed to prefabricated concrete units that are easily manufactured, transported and assembled at any site. The units can be arranged to form a cemetery in the form of either a high-rise mausoleum or a complex of mausoleums. A seal is defined by a gasket or similar material which forms a perfect airtight seal for a crypt compartment, thereby eliminating the requirement for ventilation and/or drainage in the crypt compartment.

BRIEF DESCRIPTION OF THE PRIOR ART

Tiered burial vaults, such as the type illustrated in U.S. Pat. to Gorman, Nos. 1,691,568, and Lockman, 3,287,865, suffer from certain disadvantages in that they are relatively complex in construction, cumbersome in assembly and do not provide adequate sealing protection. For instance, in the Lockman patent there is the necessity both in manufacture and assembly of having to perfectly align the interfitting elements of each of the sections joined together. In the tiered structures, as shown in the aforenoted Lockman and Gorman patents, drainage and ventilation are additional problems, requiring complicated setups to rectify them.

SUMMARY OF THE INVENTION

Accordingly, it is an object of the invention to overcome the aforementioned drawbacks in the prior art by providing a modular constructed burial crypt in the form of a mausoleum that is easily manufactured, simply installed, and sealingly secured.

In order to achieve the above-noted objects, the instant invention defines the use of a precast modular constructed unit. Each unit has a back wall, two side walls, a bottom and at least one divider wall between the two side walls that forms at least two open compartments. The top of each of the walls has canals or grooves that extend in longitudinal direction thereto. The grooves are adapted to receive resilient silicone gaskets, or other similar sealing means therein so as to provide a perfect seal between the abutting surfaces of the modular units when fitted together. In the tiered arrangement, each unit is stacked one upon each other and the uppermost unit thereof is topped off by a roof slab that results in a mausoleum type structure. The weight of each unit or roof slab is effective to compress the gasket and thereby ensure a snug fit of the gasket in the groove. This snug fit prevents the possibility of liquid or gas communicating between the compartments and/or atmosphere. In addition, the front end of the units has a recess means for the accommodation therein of a front lid which will completely close off a single compartment after the unit has been topped by another unit or roof slab. A perfect airtight compartment is thereby effected which, therefore, eliminates drainage and ventilation problems.

Other objects, advantages, and novel features of the invention will become apparent from the following detailed description of the invention when considered in conjunction with the accompanying drawings.

DETAILED DESCRIPTION OF THE PREFERRED EMBODIMENTS

Figure 1:
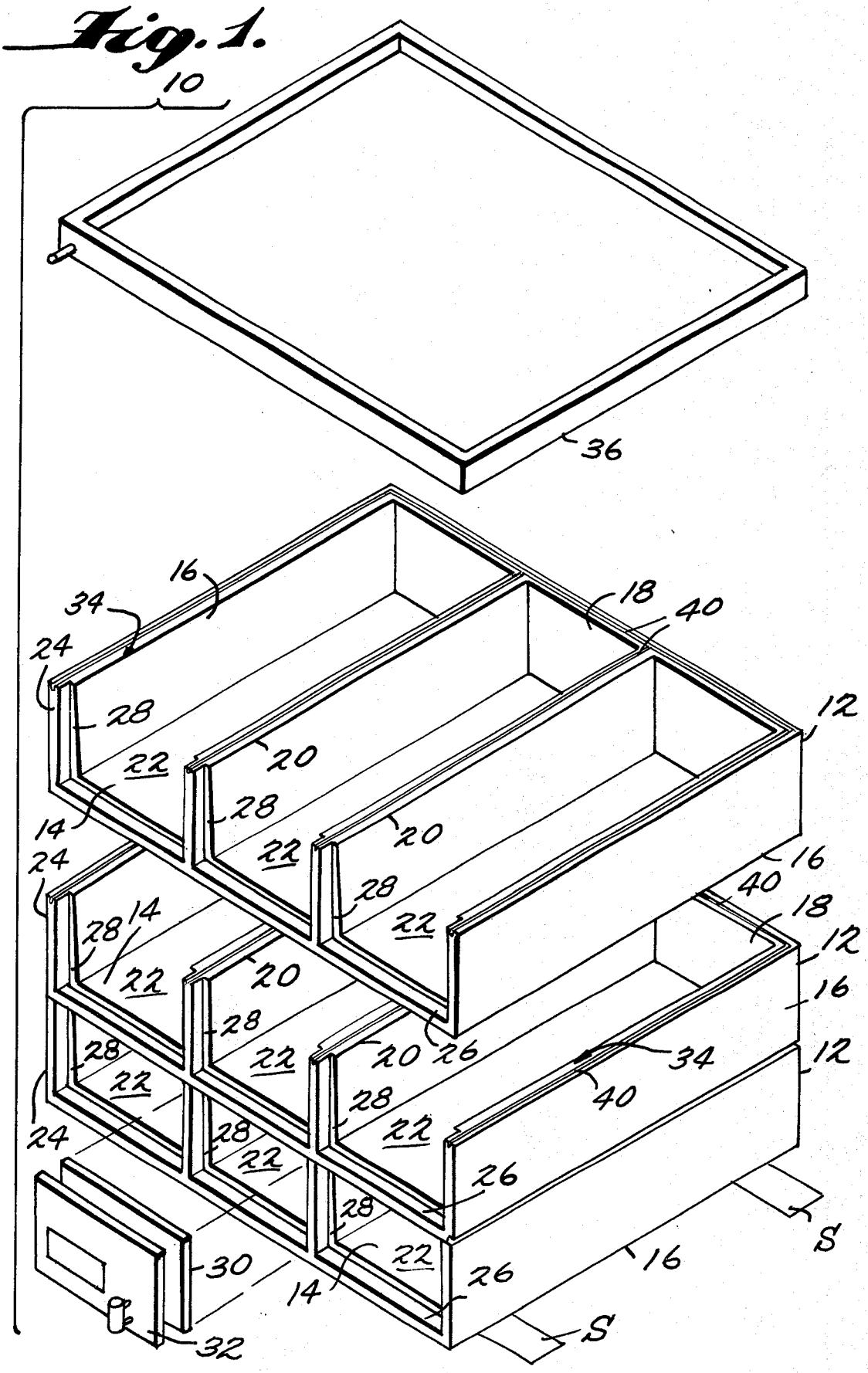
FIG. 1 is an exploded perspective view showing the components of the modular crypt made in accordance with the principles of the instant invention.

Referring now to the figures of the drawings, there is disclosed a preferred embodiment of a modular constructed burial crypt 10. Each unit 12 of the crypt is self-contained and is made from concrete that has been precast. In certain circumstances it may be required to reinforce the concrete so as to comply with building code requirements, climatic conditions or the like. As viewed in FIG. 1, a multi-tier arrangement is disclosed and as viewed in FIGS. 3 to 5, embodiments of the crypt are shown in a single tier arrangement. The multi-tier construction is especially effective in building a high-rise mausoleum structure. If desired, for aesthetic purposes the unit can be finished in any of a number of ways so as to achieve a desired appearance. Since concrete is used, the surface thereof can be veneered with marble, granite, or even painted.

Each unit 12 is identical to each other and is comprised of a bottom portion 14, a pair of upright side walls 16, an upright back wall 18 and at least one upright internal divider wall 20 located between the side walls. The internal divider walls define partially enclosed compartments 22 for the reception therein of caskets and the like. Each unit can be divided into any number of compartments but for convenience, as illustrated in the drawings, three are shown.

The front end 24 of the unit has a recess means 26 which forms a surface 28. A cover plate 30 is made of cement asbestos or the like, and is so fitted within each of the recesses 26 that it abuts against the surface 28. A conventional sealing material is utilized to seal and secure the plate to the corner surface. The material, for instance can be made from silicone or thiokol compound. In order to completely close the front of the compartments in the crypt structure, a front lid 32 is also inserted within the recesses 26 so as to have a surface of one end thereof abut against the plate 30, and the opposite surface thereof be approximately flush with the exterior of the unit 12. The lid 32 is secured to the cover plate by the same adhesive sealing and securing material used between the surface 28 and the cover plate.

The compartments 22 of each modular unit 12 are further enclosed on the top thereof by stacking a second unit upon the top surface 34 of each of the upright walls of the first of said modular units. This stacking process of the units continues until any predetermined level of units is reached. As aforenoted, the stacking process greatly facilitates the making of a high-rise structure. A roof lid or cover 36 encloses the compartments 22 by being placed in abutting contact with the top surface 34 of the uppermost unit. The resultant structure forms an airtight arrangement that improves over other known prior art crypts, in that there is no requirement for drainage and/or ventilation means.

Figure 2:
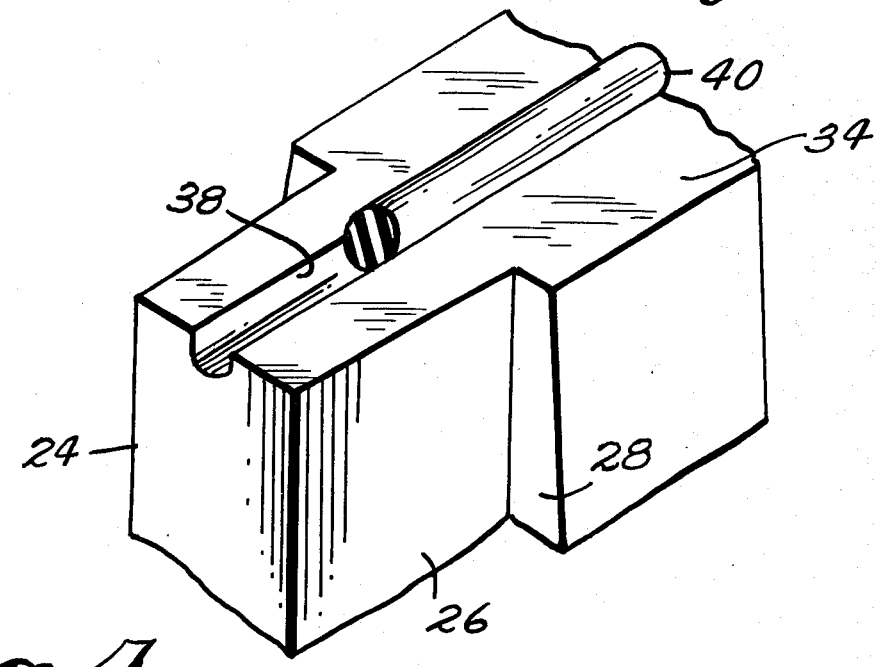
FIG. 2 is an enlarged view showing a detail of the crypt as shown in FIG. 1.

Another important feature of applicant's invention is the means by which a perfect sealing arrangement is provided between the top surface 34 of each unit and the underneath surface of each unit that abuts thereagainst. As more particularly exemplified in FIG. 2, the top surface 34 of each unit 12 is manufactured with canal or groove means 38 thereon. The grooves extend longitudinally with respect to each of the walls they are formed in, and provide a means for receiving a sealing element 40, such as a resilient silicone gasket. By placing the silicone gasket in the groove means, an extremely simple but yet effective seal is obtained. The weight and the relatively flat bottom surface of each unit or roof slab is effective to compress the gasket and thereby develop and ensure a tight or snug fit of the gasket in the groove. This snug fit prevents the possibility of liquid or gas communicating between the compartments and/or atmosphere.

It is obvious from the foregoing detailed description of the invention that the units are quite easily assembled. Conventional handling devices such as forklift trucks, etc. provide a convenient means for transporting the modular units to any site and depositing them upon stands S. As shown in FIG. 1, a high rise structure is constructed by stacking each unit 12 one upon the other. Of course, it is to be understood that the canals or grooves 38 are provided with a silicone sealing gasket before the stacking so that each unit can be sealed relative to one another. Any desired level of modular burial crypt can be obtained, with the uppermost unit of the crypt being capped by the roof lid 36. After caskets are placed into a compartment 22, the front end thereof is sealingly closed by the cover plate 30 and lid 32.

Figure 4:
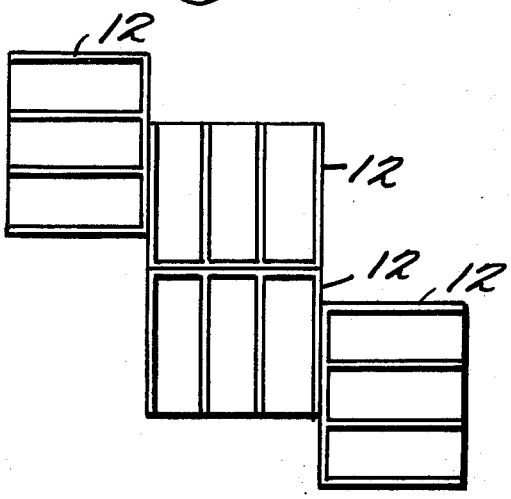
FIGS. 3 through 5 disclose various architectural positions the units can assume.
Figure 3:
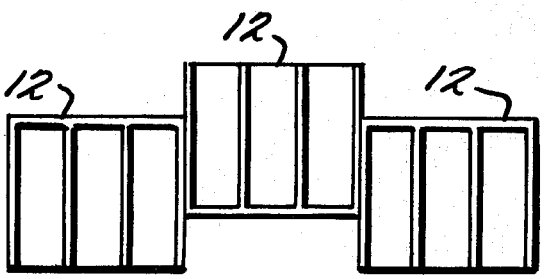
Figure 5:
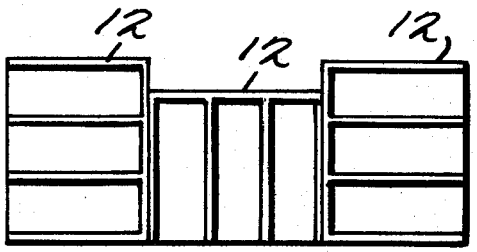

The versatility in assembly and architectural configurations offered by the modular units 12 is illustrated in FIGS. 3 through 5. For instance, the crypts can possess a staggered relationship, such as that viewed in FIG. 3, or have a diagonal arrangement as shown in FIG. 4. Another of the possible arrangements is a back-to-back combination as depicted in FIG. 5. It is to be noted, of course, that the above-noted preferred embodiments of structural relationships for the modular units is submitted by way of example as being only a few of the architectural formations that can be erected. The versatility of the precast crypt is of important significance when space and aesthetic considerations for cemeteries are taken into account. Also, as is apparent from the drawings, each unit can be arranged in any direction.

Although I have herein shown and described my invention in what I have conceived to be the most practical and preferred embodiments, it should be recognized that departures may be made therefrom within the scope of my invention, which is not to be limited to the details disclosed, but is to be accorded the full scope of the claims so as to embrace any and all equivalent structures and devices.

What is claimed is:

1. A self-contained modular burial crypt for forming a mausoleum comprising a. a precast integral modular unit having a base portion, an upright back wall portion, at least two terminal upright side wall portions and at least one upright divider wall portion positioned intermediate said terminal side wall portions for forming at least two complete open-top, openfront compartments, b. a recess means formed in the open-front of each compartment of said unit, c. closure means fitted within each of said recess means so as to close the open-front of each of said compartments, d. a resilient sealant means for sealing and securing surfaces abutting said sealant means, e. canal means extending in the longitudinal direction on the top surface of each of said upright wall portions of said unit, said canal means receiving said resilient sealant means therein, and f. a removable roof slab common to and for completely covering all of said compartments of said unit, said slab having a bottom surface thereof that abuts said resilient sealant means to completely seal each of said compartments from each other.

2. A crypt as defined in claim 1, wherein the base portion of an additional precast modular unit is stacked on the top surface of said precast modular unit, each of said modular units being sealed relative to one another with said roof slab covering said sealant means and said top surface of said additional modular unit.

3. A crypt as defined in claim 1, wherein a plurality of precast modular units are stacked successively one on top of another beginning with said precast modular unit, each of said units being sealed relative to another with said roof slab covering said sealant means and said top surface of an uppermost stacked precast modular unit.

4. A crypt as defined in claim 1, wherein said sealant means is a silicone gasket.

5. A crypt as defined in claim 1, wherein closure means includes a plate member that is sealingly secured to said recess means, and a lid means that is sealingly secured to said plate member and is flush with the front of said unit.

* * * * *

UNITED STATES PATENT OFFICE

CERTIFICATE OF CORRECTION

Patent No. 3,958,378 Dated May 25, 1976

Inventor(s) Gerardo Omeechevarria

It is certified that error appears in the above-identified patent and that said Letters Patent are hereby corrected as shown below:

The date of grant originally entered as "May 25, 1975" is changed to read --May 25, 1976-- where it appears at the upper right-hand corner of the page whereon the Abstract and other material appear.

Signed and Sealed this

Fourteenth Day of September 1976

[SEAL]

*Attest:*

RUTH C. MASON
*Attesting Officer*

C. MARSHALL DANN
*Commissioner of Patents and Trademarks*